US006663510B1

(12) United States Patent
Iwami et al.

(10) Patent No.: US 6,663,510 B1
(45) **Date of Patent: *Dec. 16, 2003**

(54) SOLID GOLF BALL

(75) Inventors: Satoshi Iwami, Akashi (JP); Akira Kato, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/662,800

(22) Filed: Sep. 15, 2000

(30) Foreign Application Priority Data

Sep. 29, 1999 (JP) ..... 11-276745

(51) Int. Cl.[7] ..... A63B 37/12; A63B 37/14; A63B 37/00

(52) U.S. Cl. ..... 473/378; 473/351

(58) Field of Search ..... 473/351, 365, 473/370, 371, 373, 374, 376, 377, 378

(56) References Cited

U.S. PATENT DOCUMENTS

| | | | | | |
|---|---|---|---|---|---|
| 3,992,561 | A | * | 11/1976 | Hargis et al. | 502/340 |
| 4,020,115 | A | * | 4/1977 | Hargis et al. | 568/700 |
| 4,033,900 | A | * | 7/1977 | Hargis et al. | 502/154 |
| 4,048,427 | A | * | 9/1977 | Hargis et al. | 502/150 |
| 4,884,814 | A | | 12/1989 | Sullivan | |
| 4,929,672 | A | * | 5/1990 | Laughner | 525/146 |
| 4,943,332 | A | * | 7/1990 | Sakaguchi et al. | 156/146 |
| 4,955,966 | A | * | 9/1990 | Yuki et al. | 437/357 |
| 5,141,233 | A | * | 8/1992 | Yuki et al. | 260/988.14 |
| 5,150,905 | A | * | 9/1992 | Yuki et al. | 260/998.14 |
| 5,231,133 | A | * | 7/1993 | Hirasawa et al. | 525/113 |
| 5,298,562 | A | * | 3/1994 | Ceska et al. | 524/721 |
| 5,542,663 | A | * | 8/1996 | Kato et al. | 473/363 |
| 5,716,293 | A | | 2/1998 | Yabuki et al. | |
| 5,849,392 | A | * | 12/1998 | Hamada et al. | 428/159 |
| 5,989,136 | A | * | 11/1999 | Renard et al. | 473/373 |
| 6,114,453 | A | * | 9/2000 | Irii et al. | 525/221 |
| 6,130,295 | A | * | 10/2000 | Yokota | 525/221 |
| 6,335,400 | B1 | * | 1/2002 | Yabuki et al. | 473/378 |
| 6,359,065 | B1 | * | 3/2002 | Yabuki | 473/372 |
| 6,359,066 | B1 | * | 3/2002 | Yabuki | 473/354 |

FOREIGN PATENT DOCUMENTS

| | | | | | |
|---|---|---|---|---|---|
| GB | A2311530 | | | 10/1997 | |
| JP | 2001070475 | A | * | 3/2001 | A63B/37/00 |
| JP | 2001070479 | A | * | 3/2001 | A63B/37/00 |
| JP | 2001095948 | A | * | 4/2001 | A63B/37/00 |
| JP | 2001327631 | A | * | 11/2001 | A63B/37/00 |

OTHER PUBLICATIONS

Callister, Jr., William D., Materials Science and Engineering: An Introduction, Fourth Edition. Ney York: John Wiley & Sons, Inc., 1997, p. 498.*

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

The present invention provides a solid golf ball keeping excellent hit feeling equivalent to that of a conventional solid golf ball, providing a large spinning quantity when driven with a short iron or the like, easy to stop and having high spinning retention. The solid golf ball according to the present invention consists of a core and a cover coating the core, and the cover is made of a mixture of ionomer resin, thermoplastic elastomer and a tackifier while Shore D hardness thereof is at least 40 and not more than 65.

7 Claims, No Drawings

SOLID GOLF BALL

BACKGROUND OF THE INVENTION

1. Field of the Invention

The present invention relates to a solid golf ball providing excellent hit feeling, exhibiting a large carry, remarkably spinning when hit from the rough or on a rainy day, and easy to stop.

2. Description of the Prior Art

In general, a golf ball prepared by forming a rubber thread layer on a liquid core and covering the same with balata is excellent in hit feeling and controllability, and widely used by experienced golfers and pro golfers. However, the golf ball having such a structure requires complicated manufacturing steps and is inferior in cutting resistance, and hence various types of soft cover materials are recently proposed in place of the balata cover.

For example, soft ionomer resin is employed as the base resin for such a cover for a golf ball, as described in U.S. Pat. No. 4,884,814 (1989). However, a golf ball covered with such soft ionomer resin exhibits an inferior spinning quantity under a wet condition as compared with that under a dry condition, and is hence insufficient in spinning retention.

GB2311530 (1997) proposes a golf ball covered with base resin mainly composed of a hot two-component mixture of ionomer resin and a styrene-butadiene-styrene block copolymer having a polybutadiene block containing epoxy groups or a styrene-isoprene-styrene block copolymer having a polyisoprene block containing epoxy groups. The composition forming the cover has flexural rigidity of 50 to 300 MPa and Shore D hardness of 40 to 60. While the golf ball provides excellent hit feeling and controllability and can satisfy flyability and cutting resistance, this technique does not aim at improving spinning retention.

The inventors have already proposed a technique of improving hit feeling of a golf ball and increasing the spinning quantity of the golf ball hit with a short iron by employing a solid rubber core containing oily matter and a soft cover material (U.S. Pat. No. 5,716,293 (1998)).

However, this golf ball, employing oilproof rubber and hard ionomer resin on the outer side of the solid rubber core, must still be improved in bounce and hit feeling.

SUMMARY OF THE INVENTION

An object of the present invention is to provide a soft solid golf ball providing excellent hit feeling as well as a large carry, exhibiting a large spinning quantity also when hit from the rough or on a rainy day, and easy to stop.

The present invention provides a solid golf ball consisting of a core and a cover coating the core, characterized in that the cover is made of a mixture of ionomer resin, thermoplastic elastomer and a tackifier and has Shore D hardness of at least 40 and not more than 65.

The foregoing and other objects, features, aspects and advantages of the present invention will become more apparent from the following detailed description of the present invention.

DESCRIPTION OF THE PREFERRED EMBODIMENTS

The present invention provides a solid golf ball consisting of a core and a cover coating the core.

According to the present invention, ionomer resin employed as the base resin for the cover is prepared from a binary copolymer of α-olefin and α,β-unsaturated carboxylic acid having a carbon number of 3 to 8 obtained by at least partially neutralizing carboxyl groups thereof with metal ions, for example. Alternatively, the ionomer resin may be prepared from a terpolymer of α-olefin, α,β-unsaturated carboxylic acid having a carbon number of 3 to 8 and α,β-unsaturated carboxylic ester having a carbon number of 2 to 22 obtained by at least partially neutralizing carboxyl groups thereof with metal ions. As to the composition ratio, the base polymer of the ionomer resin preferably contains 80 to 90 percent by weight of α-olefin and 10 to 20 percent by weight of α,β-unsaturated carboxylic acid when prepared from the binary copolymer of α-olefin and α,β-unsaturated carboxylic acid having a carbon number of 3 to 8. When prepared from the terpolymer of α-olefin, α,β-unsaturated carboxylic acid having a carbon number of 3 to 8 and α,β-unsaturated carboxylic ester having a carbon number of 2 to 22, the base polymer preferably contains 70 to 85 percent by weight of α-olefin, 5 to 20 percent by weight of α,β-unsaturated carboxylic acid and 10 to 25 percent by weight of α,β-unsaturated carboxylic ester. The melt index (MI) of such ionomer resin is preferably 0.1 to 20, particularly 0.5 to 15.

The aforementioned α-olefin is prepared from ethylene, propylene, 1-butene or 1-pentene, for example, and ethylene is particularly preferable. The α,β-unsaturated carboxylic acid having a carbon number of 3 to 8 is prepared from acrylic acid, methacrylic acid, fumaric acid, maleic acid or crotonic acid, for example, and acrylic acid or methacrylic acid is particularly preferable. The α,β-unsaturated carboxylic ester is prepared from methyl, ethyl, propyl, n-butyl or isobutyl ester of acrylic acid, methacrylic acid, fumaric acid or maleic acid, for example, and acrylate or methacrylate is particularly preferable. The metal ions for at least partially neutralizing the carboxyl groups contained in the aforementioned copolymer of α-olefin and α,β-unsaturated carboxylic acid or the terpolymer of α-olefin, α,β-unsaturated carboxylic acid and α,β-unsaturated carboxylic ester may be sodium ions, lithium ions, zinc ions, magnesium ions or potassium ions, for example. The ionomer resin is preferably of the so-called high-rigidity high-flow type having a melt index of 3 to 7 and flexural rigidity of 200 to 400 MPa when obtained by at least partially neutralizing carboxyl groups contained in a copolymer of ethylene and acrylic acid or methacrylic acid with metal ions.

Exemplary products of the aforementioned ionomer resin are Hi-milan 1555 (Na), Hi-milan 1557 (Zn), Hi-milan 1605 (Na), Hi-milan 1706 (Zn), Hi-milan 1707 (Na), Hi-milan AM7318 (Na), Hi-milan AM7315 (Zn), Hi-milan AM7317 (Zn), Hi-milan AM7311 (Mg) and Hi-milan MK7320 (K) by Du Pont-Mitsui Polychemical Co., Ltd., and exemplary products of the terpolymer ionomer resin are Hi-milan 1856 (Na), Hi-milan 1855 (Zn) and Hi-milan AM7316 (Zn). Exemplary products of ionomer resin by Du Pont Co. Ltd. are Surlyn 8945 (Na), Surlyn 8940 (Na), Surlyn 9910 (Zn), Surlyn 9945 (Zn), Surlyn 7930 (Li) and Surlyn 7940 (Li), and exemplary products of the terpolymer ionomer resin are Surlyn AD8265 (Na) and Surlyn AD8269 (Na).

Exemplary products of ionomer resin by Exxon Corporation are Iotek 7010 (Zn) and Iotek 8000 (Na). "Na", "Zn", "K", "Li" and "Mg" in the parentheses following the aforementioned trade names of ionomer indicate the metal species of the neutralizing metal ions. At least two types of the aforementioned ionomer resin may be mixed with each other, or at least two types of ionomer resin neutralized with the aforementioned univalent metal ions and ionomer resin neutralized with bivalent metal ions may be mixed with each other for the base resin employed for the cover in the present invention.

The cover material for the solid golf ball according to the present invention is mixed with at least single thermoplastic elastomer having a soft segment and a hard segment. The thermoplastic elastomer is prepared from polystyrene elastomer, polyester elastomer or polyurethane elastomer, while a block copolymer having a conjugated diene compound such as a butadiene block or an isoprene block is particularly preferable. One or more materials can be selected from butadiene, isoprene, 1,3-pentadiene and 2,3-dimethyl-1,3-butadiene, for example, for the conjugated diene compound, and butadiene, isoprene or a combination thereof is particularly preferable. One or more materials can be selected from styrene, α-methylstyrene, vinyltoluene, p-tertiary butylstyrene and 1,1-diphenylethylene for forming another block copolymer, and styrene is preferable.

More specifically, the block copolymer may be a styrene-isoprene-butadiene-styrene copolymer (SIBS structure), a styrene-butadiene-styrene block copolymer (SBS structure), a styrene-ethylene-butylene-styrene block copolymer (SEBS structure) prepared by hydrogenating a double bond part of butadiene thereof, an ethylene-isoprene-styrene block copolymer (SIS structure), a styrene-ethylene-propylene-styrene block copolymer (SEPS structure) prepared by hydrogenating a double bond part of isoprene thereof, a styrene-ethylene-ethylene-propylene-styrene block copolymer (SEEPS structure) or a modified substance of any of these copolymers, for example.

The content of styrene (or a monomer substituting therefor) in the aforementioned SIBS, SBS, SEBS, SIS, SEPS or SEEPS structure is in the range of 10 to 50 percent by weight, particularly 15 to 45 percent by weight in the copolymer. The cover is excessively softened and tends to be reduced in cutting resistance if the content of styrene is not more than 10 percent by weight, while the ionomer resin cannot be sufficiently softened but hit feeling as well as controllability of the ball are deteriorated if the content of styrene exceeds 50 percent by weight.

According to the present invention, the aforementioned copolymer of the SIBS, SBS, SEBS, SIS, SEPS or SEEPS structure may partially contain epoxy groups.

For example, a styrene-butadiene-styrene block copolymer (SBS structure) having a polybutadiene block containing epoxy groups may be a block copolymer having polystyrene on both ends with an intermediate layer of polybutadiene containing epoxy groups prepared by partially or entirely hydrogenating double bonds of the polybutadiene part, and a styrene-isoprene-styrene block copolymer (SIS structure) having a polyisoprene block containing epoxy groups may be a block copolymer having polystyrene on both ends with an intermediate layer of polyisoprene containing epoxy groups prepared by partially or entirely hydrogenating double bonds of the polyisoprene part.

The epoxy group content in the block copolymer of the epoxidized SBS or SIS structure is preferably 0.05 to 10 percent by weight, particularly 0.2 to 5 percent by weight. The amount of reaction between the epoxy groups and free carboxyl groups contained in the ionomer resin is so reduced that dispersibility of the block copolymer of the epoxidized SBS or SIS structure in the ionomer resin may be reduced to deteriorate endurance if the epoxy group content is not more than 0.05 percent by weight, while the amount of reaction between the epoxy groups and the free carboxyl groups contained in the ionomer resin is so excessively increased that flowability may be deteriorated to cause difficulty in molding of the golf ball if the epoxy group content exceeds 10 percent by weight.

Products of the block copolymer of the epoxidized SBS or SIS structure are styrene-butadiene-styrene block copolymers (SBS structure) containing epoxy groups put on the market in trade names such as Epofriend A1010 and ESB by Daicel Chemical Industries, Ltd. and styrene-butadiene-styrene block copolymers prepared by partially hydrogenating polybutadiene blocks containing epoxy groups put on the market in trade names such as ESBS AT018 and ESBS AT019, for example. Any of these products is preferably employed in the present invention.

An exemplary product of the aforementioned block copolymer of the SEBS or SEPS structure having hydroxyl groups added to both ends is HG-252 by Kuraray Co., Ltd., for example.

In the present invention, the aforementioned ionomer resin is hot-mixed with the thermoplastic elastomer having the SBS or SIS structure, for attaining desired coverability. These materials are hot-mixed with each other in an internal mixer such as a general kneading type biaxial extruder, a Bambury mixer or a kneader at 150 to 260° C., for example.

The tackifier employed for the cover of the solid golf ball according to the present invention is prepared from coumarone-indene resin, terpene resin, a rosin derivative, phenol-formaldehyde resin, alkyl-phenol resin, petroleum resin, xylene-formaldehyde resin, olygomer such as polybutene or liquid rubber such as liquid polyisoprene, while terpene resin or rosin ester resin is particularly preferable.

The aforementioned terpene resin is a polymer of a terpene monomer or a polymer containing a second component in a polymer chain, and includes terpene resin having a basic structure expressed in the following general formula (1), styrene terpene resin having a basic structure expressed in the following general formula (2), phenol modified terpene resin having a basic structure expressed in the following general formula (3) and hydrogenated terpene resin prepared by hydrogenating such resin:

Formula (1)

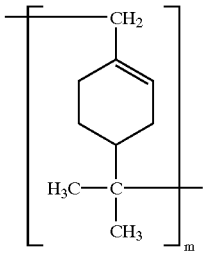

Formula (2)

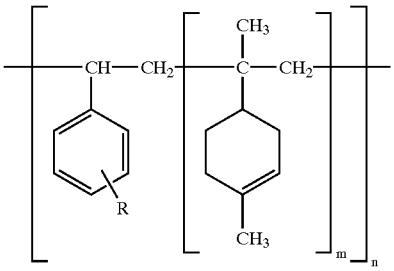

-continued

Formula (3)

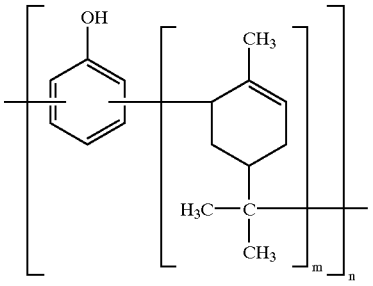

Referring to the above general formulas (1) to (3), m and n represent integers.

Exemplary products of such a tackifier are Process Resin A81, Process Resin AC5 and Process Resin TX by Kobe Oil Chemical Industry Co., Ltd., Coumarone CL by Ouchi-shinko Chemical Industries, Ltd. and Coumarone Resin NG4 by Nippon Steel Chemical Industries, Ltd. Exemplary products of terpene-phenol resin is Tackirol 101, Tackirol 160, Tackirol EP20 and Tackirol EP30 by Sumitomo Chemical Co., Ltd. and Sumilight Resin PR19900 by Sumitomo Dulez Co., Ltd.

Exemplary products of petroleum resin are hydrogenated terpene resin Clearon P105 by Yasuhara Chemical Co., Ltd., Arkon P90 and Ester gum H by Arakawa Chemical Industries, Ltd. and *1 #80 and Hilets G100X by Mitsui Petrochemical Industries, Ltd.

Exemplary products of a rosin derivative are Nikanol A70 by Mitsubishi Gas Chemical Co., Inc., Lignol R70 by Libnite and Rosin Ester Resin by Arakawa Chemical Industries, Ltd.

The tackifier is dispersed in/mixed with the base resin for the cover for providing proper tackiness to the cover and improving tackiness to a club face when the golf ball is hit for improving spinning retention.

Assuming that the total content of the ionomer resin, the thermoplastic elastomer and the tackifier is 100 parts by weight, the material for the cover preferably contains 30 to 70 percent by weight of the ionomer resin, 20 to 60 percent by weight of the thermoplastic elastomer and 5 to 30 percent by weight of the tackifier in the present invention. If the content of the ionomer resin is too small, the cover is disadvantageously softened and reduced in bounce. If the content of the ionomer resin is too large, spinning retention is reduced. If the content of the thermoplastic elastomer is too small, the effect of the tackifier is so hard to attain that spinning retention is reduced. If the content of the thermoplastic elastomer is too large, the cover is excessively softened.

The cover of the solid golf ball according to the present invention has Shore D hardness of 40 to 65, preferably 43 to 63, more preferably 45 to 60 in the state coating the solid core, i.e., in ball cover hardness. The cover is excessively softened to slow the initial speed of the ball if the Shore D hardness is less than 40, while the spinning quantity is reduced when the ball is hit with a short iron or the like if the Shore D hardness exceeds 65. The Shore D hardness is measured according to ASTMD-2240.

According to the present invention, a filler of barium sulfate, a coloring agent of titanium dioxide or still another additive such as a dispersant, an antioxidant, an ultraviolet absorber, a light stabilizer, a fluorescent material and/or an optical whitening agent may be added to the composition for the aforementioned cover at need within a range not deteriorating desired characteristics of the cover for the golf ball in addition to the aforementioned resin serving as the main component, while the content of the coloring agent is preferably 1.0 to 6.0 parts by weight in general.

According to the present invention, the core is prepared from that for a solid ball such as a two-piece ball or a three-piece ball in view of endurance. While the core is made of a cross-linked substance of a rubber composition, the rubber component of the rubber composition is suitably prepared from butadiene rubber having a cis-1,4-structure. In place of such butadiene rubber, natural rubber, styrene-butadiene rubber, isoprene rubber, chloroprene rubber, butyl rubber, ethylene-propylene rubber, ethylene-propylene-diene rubber, acrylonitrile rubber or the like may be blended in an amount of not more than 40 parts by weight with respect to 100 parts by weight of the rubber component.

A cross-linking agent employed for the aforementioned rubber composition is prepared from a material generally employed as a cross-linking agent such as a material prepared by reacting α,β-ethylene unsaturated carboxylic acid such as acrylic acid or methacrylic acid, for example, and a metal oxide such as zinc oxide with each other during preparation of the rubber composition for forming metal salt of α,β-ethylene unsaturated carboxylic acid, metal salt of α,β-ethylene unsaturated carboxylic acid such as zinc acrylate or zinc methacrylate, for example, a polyfunctional monomer, N,N'-phenyl bismaleimide or sulfur, while metal salt of α,β-ethylene unsaturated carboxylic acid, particularly zinc salt, is preferable in particular. For example, the content of the metal salt of α,β-unsaturated carboxylic acid is preferably 20 to 40 parts by weight with respect to 100 parts by weight of the rubber component, while it is preferable to blend 15 to 30 parts by weight of α,β-ethylene unsaturated carboxylic acid and 15 to 35 parts by weight of the metal oxide such as zinc oxide with respect to 100 parts of the α,β-ethylene unsaturated carboxylic acid when reacting the α,β-ethylene unsaturated carboxylic acid and the metal oxide with each other during preparation of the rubber composition.

The filler employed for the aforementioned rubber composition can be prepared from one or more of organic powder of barium sulfate, calcium carbonate, clay and zinc oxide, for example. The content of the filler is preferably in the range of 5 to 50 parts by weight with respect to 100 parts by weight of the rubber component.

A softening agent or liquid rubber may be properly blended in order to improve workability or adjust hardness, while an antioxidant may be properly blended.

A cross-linking initiator is prepared from organic peroxide such as dicumyl peroxide or 1,1-bis(t-butylperoxy)3,3,5-trimethyl cyclohexane, for example. The cross-linking initiator is preferably blended by 0.1 to 5 parts by weight, particularly 0.3 to 3 parts by weight with respect to 100 parts by weight of the rubber component.

According to the present invention, the aforementioned core may be of a single layer or a composite layer having different characteristics such as specific gravity and hardness. In this case, the contents of the materials for the core are not restricted to the above.

The aforementioned materials are mixed with each other with a roll, a kneader, a Bambury mixer or the like and vulcanized with a mold under pressure at a temperature of 145 to 200° C., preferably 150 to 175° C., for 10 to 40 minutes for preparing the core. The surface of the obtained core may be coated with an adhesive or roughened for improving adhesion to the cover.

The cover of the solid golf ball according to the present invention can be molded by a well-known method. Two semispherical half shells previously formed by the cover composition may be employed for covering the solid core and pressure-molded at 130 to 170° C. for 1 to 5 minutes, or the aforementioned cover composition may be directly injection-molded onto the solid core for covering the solid core. The thickness of the cover is 0.8 to 3.0 mm, preferably 1.2 to 2.5 mm. The cover is readily cracked when the ball is repeatedly hit if the thickness of the cover is not more than 0.8 mm, while hit feeling of the ball is deteriorated if the thickness of the cover exceeds 3.0 mm. When molding the cover, a number of dimples are formed on the surface thereof at need. The solid golf ball according to the present invention is generally finished with paint and provided with a marking stamp or the like for improving the appearance as well as the commercial value, and put on the market.

According to the present invention, the cover can have a single layer or a plurality of layers.

EXAMPLES

Examples 1 to 6 and Comparative Examples 1 to 4

(1) Preparation of Inner Core

Materials for a rubber composition for a core shown in Table 1 were kneaded and hot-pressed in a mold at 142° C. for 16 minutes and at 168° C. for 8 minutes thereby preparing cores of 39 mm in diameter.

(2) Preparation of Cover Composition

Materials for covers shown in Table 2 were mixed in a biaxial kneading extruder for obtaining pellet-type cover compositions. Extrusion conditions were as follows:

Screw Diameter: 45 mm

Screw Rotational Frequency: 200 rpm

Screw L/D: 35

The blended materials were heated to 200 to 260° C. on the position of a die of the extruder.

Semispherical half shells were formed by the obtained cover compositions. In each sample, two such half shells were employed for covering the aforementioned core and pressed/thermocompression-molded in a mold, and the surface of the obtained molding was painted for preparing a golf ball having an outer diameter of 42.8 mm.

The obtained golf balls were subjected to evaluation of cover hardness (Shore D hardness), flyability including the initial speed, the spinning quantity and the carry, and hit feeling. Table 2 shows the results.

The physical properties of each golf ball were evaluated as follows:

(1) Spinning Quantity

A SW club was mounted on a swing robot by True Temper for hitting the golf ball at a head speed of 20 m/sec., and the hit golf ball was sequentially photographed for obtaining the spinning quantity.

The spinning quantity was measured under a general dry condition and under a wet condition moistening the clubface with water.

The spinning retention (%) is defined as follows:

(spinning quantity under wet condition)/(spinning quantity under dry condition)×100

(2) Hit Feeling

Hit feeling was evaluated by an actual hitting test made by 10 top-ranking pro golfers with the following criteria:

CRITERIA

○: At least seven among the ten answered that the ball excellently felt soft.

Δ: Four to six among the ten answered that the ball excellently felt soft.

x: Not more than three among the ten answered that the ball excellently felt soft.

Table 2 shows the results of measurement of the golf balls according to Examples 1 to 6 and comparative examples 1 to 4. It is understood all golf balls according to Examples are superior in carry, spinning retention and hit feeling to those according to comparative examples.

The golf balls according to comparative examples 1 and 2 containing no tackifiers exhibited small spin quantities under wet conditions and inferior spinning retention although the same presented excellent hit feeling.

The golf ball according to comparative example 3, containing no elastomer having a rubber component, was not reduced in hardness while spinning retention thereof was deteriorated although the material for the cover contained a tackifier. Further, this golf ball was out of the normal range in hardness and inferior in hit feeling.

The golf ball according to comparative example 4 containing only ionomer resin exhibited low spinning retention.

TABLE 1

| Ingredient | Parts by Weight |
|---|---|
| polybutadiene[X1] | 100 |
| zinc acrylate | 34 |
| zinc oxide | 16 |
| antioxidant[X2] | 0.5 |
| dicumyl peroxide[X3] | 1.1 |
| sulfur compound[X4] | 0.5 |
| deformation of solid core (mm) (with load of 10 to 130 Kg) | 2.8 |

[X1]BR-18 by Japan Synthetic Rubber Co., Ltd.
[X2]Yoshinox 425 by Yoshitomi Pharmaceutical Industries, Ltd.
[X3]Percumyl D by Nippon Oil and Fats Co., Ltd.
[X4]diphenyl disulfide by Sumitomo Seika Chemicals, Co., Ltd.

TABLE 2

| | | | Example | | | | | | Comparative Example | | | |
|---|---|---|---|---|---|---|---|---|---|---|---|---|
| | | | 1 | 2 | 3 | 4 | 5 | 6 | 1 | 2 | 3 | 4 |
| Ingredi- | ionomer | Surlyn 8945[X1] | 20 | 20 | 18 | 23 | | | 25 | 20 | | |
| ent | resin | Surlyn 9945[X2] | 20 | 20 | 18 | 22 | | | 25 | 20 | | |
| | (A) | Iotek 7010[X3] | | | | | 25 | 22.5 | | | 20 | 10 |
| | | Iotek 8000[X4] | | | | | 25 | 22.5 | | | 20 | 5 |
| | | Hi-milan 1855[X5] | | | | | | | | | 42 | 85 |

TABLE 2-continued

| | | | Example | | | | | | Comparative Example | | | |
|---|---|---|---|---|---|---|---|---|---|---|---|---|
| | | | 1 | 2 | 3 | 4 | 5 | 6 | 1 | 2 | 3 | 4 |
| | thermo-plastic elastomer (B) | HG252·X·[6] | 30 | 30 | 36 | 45 | 30 | 35 | 35 | 40 | | |
| | | Epofriend A1010·X·[7] | 12 | 12 | 18 | | | | 15 | 20 | | |
| | tackifier (C) | Clearon P105·X·[8] | 18 | | 10 | 10 | 20 | 20 | — | — | 18 | — |
| | | Ester gum H·X·[9] | | 18 | | | | | | | | |
| | blending ratio (A/B/C) | | 40/42/18 | 40/42/18 | 36/54/10 | 45/45/10 | 50/30/20 | 45/35/20 | 50/50/0 | 40/60/0 | 82/0/18 | 100/0/0 |
| | titanium oxide | | 2 | 2 | 2 | 2 | 2 | 2 | 2 | 2 | 2 | 2 |
| | barium sulfate | | 2 | 2 | 2 | 2 | 2 | 2 | 2 | 2 | 2 | 2 |
| Physical Property | cover hardness (Shore D hardness) | | 48 | 50 | 49 | 52 | 53 | 50 | 58 | 50 | 67 | 60 |
| | spinning quantity under dry condition (rpm) | | 7200 | 7100 | 6900 | 6800 | 6900 | 7000 | 7200 | 7400 | 7000 | 7100 |
| | spinning quantity under wet condition (rpm) | | 3800 | 3700 | 3380 | 3000 | 3000 | 3500 | 2500 | 2500 | 2250 | 2350 |
| | spinning retention (%) | | 54 | 52 | 49 | 44 | 43 | 50 | 35 | 34 | 32 | 33 |
| | hit feeling | | ○ | ○ | ○ | ○ | ○ | ○ | ○ | ○ | X | Δ |

X·[1]ethylene-methacrylic acid copolymer ionomer resin neutralized with sodium ions by Du Pont Co., Ltd. having MI of 4.8 and flexural rigidity of about 280 MPa X·[2]ethylene-methacrylic acid copolymer ionomer resin neutralized with zinc ions by Du Pont Co., Ltd. having MI of 5.2 and flexural rigidity of about 220 MPa X·[3]ethylene-acrylic acid copolymer ionomer resin neutralized with zinc ions by Exxon Corporation X·[4]ethylene-acrylic acid copolymer ionomer resin neutralized with sodium ions by Exxon Corporation X·[5]ethylene-methacrylic acid-isobutyl acrylate terpolymer ionomer resin neutralized with zinc ions by Du Pont-Mitsui Polychemical Co., Ltd.

X·[6]hydrogenated SIBS (SEEPS-OH) having hydroxyl groups added to polymer chain ends by Kuraray Co., Ltd. having a styrene content of 28 wt. % and an isoprene/butadiene weight ratio of 55/45

X·[7]epoxidized SBS by Daicel Chemical Industries, Ltd. having an epoxy equivalent of 950 to 1050 and a butadiene/styrene weight ratio of 60/40

X·[8]hydrogenated terpene resin by Yasuhara Chemical Co., Ltd.

X·[9]hydrogenated rosin ester resin by Arakawa Chemical Industries, Ltd.

Although the present invention has been described in detail, it is clearly understood that the same is by way of illustration and example only and is not to be taken by way of limitation, the spirit and scope of the present invention being limited only by the terms of the appended claims.

The solid golf ball according to the present invention, prepared by blending ionomer resin, thermoplastic elastomer and a tackifier in a cover material for a golf ball having a solid core, is as soft as a conventional three-piece ball, provides excellent hit feeling, exhibits a large spinning quantity when hit with a short iron or the like, easy to stop, and improved in a ratio of a spinning quantity under a wet condition to that under a dry condition, i.e., spinning retention.

What is claimed is:

1. A solid golf ball consisting of a core and a cover coating said core, wherein said cover is made of a mixture of ionomer resin, thermoplastic elastomer and a tackifier and has Shore D hardness of at least 40 and not more than 65, and said cover contains 30 to 70 percent by weight of said ionomer resin, 20 to 60 percent by weight of said thermoplastic elastomer and 5 to 30 percent by weight of said tackifier assuming that the total quantity of said ionomer resin, said thermoplastic elastomer and said tackifier forming said cover is 100 parts by weight.

2. The solid golf ball according to claim 1, wherein said thermoplastic elastomer forming said cover is a styrene-isoprene-butadiene-styrene block copolymer (SIBS structure), a styrene-butadiene-styrene block copolymer (SBS structure), a styrene-ethylene-butylene-styrene block copolymer (SEBS structure) prepared by hydrogenating a double bond part of butadiene thereof, an ethylene-isoprene-styrene block copolymer (SIS structure), a styrene-ethylene-propylene-styrene block copolymer (SEPS structure) prepared by hydrogenating a double bond part of isoprene thereof, a styrene-ethylene-ethylene-propylene-styrene block copolymer (SEEPS structure) or a modified substance of any of said copolymers.

3. The solid golf ball according to claim 1, wherein said tackifier is terpene resin or rosin ester resin.

4. The solid golf ball according to claim 1, wherein said cover contains said ionomer resin, said thermoplastic elastomer and 5 to 30 percent by weight of said tackifier assuming that the total quantity of said ionomer resin, said thermoplastic elastomer and said tackifier forming said cover is 100 parts by weight.

5. A solid golf ball consisting of a core and a cover coating said core, wherein said cover is made of a mixture of ionomer resin, thermoplastic elastomer and a tackifier and has Shore D hardness of at least 40 and not more than 65, and said cover contains said ionomer resin, said thermoplastic elastomer and 5 to 30 percent by weight of said tackifier assuming that the total quantity of said ionomer resin, said thermoplastic elastomer and said tackifier forming said cover is 100 parts by weight.

6. The solid golf ball according to claim 5, wherein said thermoplastic elastomer forming said cover is a styrene-isoprene-butadiene-styrene block copolymer (SIBS structure), a styrene-butadiene-styrene block copolymer (SBS structure), a styrene-ethylene-butylene-styrene block copolymer (SEBS structure) prepared by hydrogenating a double bond part of butadiene thereof, an ethylene-isoprene-styrene block copolymer (SIS structure), a styrene-ethylene-propylene-styrene block copolymer (SEPS structure) prepared by hydrogenating a double bond part of isoprene thereof, a styrene-ethylene-ethylene-propylene-styrene block copolymer (SEEPS structure) or a modified substance of any of said copolymers.

7. The solid golf ball according to claim 5, wherein said tackifier is terpene resin or rosin ester resin.

* * * * *